US007533858B2

(12) United States Patent
Straus

(10) Patent No.: US 7,533,858 B2
(45) Date of Patent: May 19, 2009

(54) FURNITURE GLIDE

(75) Inventor: Albert E. Straus, Timonium, MD (US)

(73) Assignee: ACP, LLC, Alabaster, AL (US)

( * ) Notice: Subject to any disclaimer, the term of this patent is extended or adjusted under 35 U.S.C. 154(b) by 307 days.

(21) Appl. No.: 10/905,944

(22) Filed: Apr. 5, 2005

(65) Prior Publication Data

US 2006/0231702 A1 Oct. 19, 2006

(51) Int. Cl.
*F16M 11/20* (2006.01)

(52) U.S. Cl. ..... 248/188.8; 248/188.2

(58) Field of Classification Search ..... 248/188.8, 248/188.9, 188.91, 188; 135/77, 82, 84, 135/86; 16/42 R, 42 T
See application file for complete search history.

(56) References Cited

U.S. PATENT DOCUMENTS

| | | | | |
|---|---|---|---|---|
| 2,644,978 | A | 7/1953 | Becker | 16/42 |
| 2,968,116 | A | 1/1961 | Arenson | 45/137 |
| 3,177,518 | A | 4/1965 | Bergstrom | 16/42 |
| 3,389,421 | A | 6/1968 | Wheeler | 16/42 |
| 5,191,676 | A | 3/1993 | Gerner | 16/42 |
| D372,192 | S * | 7/1996 | Pigott et al. | D8/499 |
| 5,557,824 | A | 9/1996 | Bushey | 16/42 |
| 5,680,673 | A | 10/1997 | Beshore | 16/42 |
| 6,219,882 | B1 | 4/2001 | Olson | 16/42 |
| 6,279,592 | B1 * | 8/2001 | Yamamoto | 135/77 |
| 6,405,982 | B2 | 6/2002 | Ferencz | 248/188.9 |
| 6,802,482 | B2 * | 10/2004 | Harris | 248/188.9 |
| 6,910,246 | B2 * | 6/2005 | Desmarais | 16/42 R |
| 7,234,199 | B2 * | 6/2007 | Bushey | 16/42 R |
| 2002/0190179 | A1 | 12/2002 | Rydell et al. | 248/346.11 |

* cited by examiner

*Primary Examiner*—J. Allen Shriver
*Assistant Examiner*—Steven Marsh
(74) *Attorney, Agent, or Firm*—Richard K Thomson; Jon L. Woodard

(57) ABSTRACT

A furniture glide is mountable on the foot of a furniture leg. The glide is constructed around a glide base having an inner portion and foot support surface. A plurality of spring fingers positioned on the glide base have attached and distal ends. The distal ends extend in an inward direction toward the inner portion of the glide base. The distal ends also extend in an outward direction away from the foot support surface. The positioning of heads at about the distal end of each spring finger allows the spring fingers to receive an outward expansion force when the foot is moved toward the foot support surface. The spring fingers are positioned to move in an inward direction toward the inner portion of the glide base to lock the foot to the furniture glide when the foot contacts the foot support surface.

72 Claims, 11 Drawing Sheets

FURNITURE GLIDE

BACKGROUND

Feet are frequently positioned on the bottoms of furniture legs to provide improved stability and support, reinforcement, wear reduction or for other purposes where the major structural material of the furniture leg is not the preferred material for providing contact with a surrounding floor. A foot is typically attached to bottom end of a furniture leg so that a contact surface of the foot will contact the floor, the contact surface exerting the load of the leg against the area of floor it contacts. The contact surface preferably comprises a material that minimizes wear and damage to the leg or surrounding floor and may have optional properties that provide transportability, enhanced stabilization, noise and/or friction reduction, or other desirable characteristics.

However, no single foot or single type of contact surface material can be optimally suited for providing all desired properties and characteristics for use with all floor types and floor materials. For example, it may be desirable to use a a piece of furniture in a room having a floor type that is different from the type that the feet of the furniture piece were originally designed for. Feet can also lose some of their desired characteristics after extended use. For example, contact surface material may become worn or damaged and a foot can itself become slightly bent or deformed to an extent that the foot loses some or all of its original desirable characteristics. In some cases, feet may be constructed specifically for purposes such as stability or leg protection, and may lack a suitable contact surface altogether. It may also be desirable to preserve the furniture piece's original feet and contact material from damage or wear due for other reasons, such as for aesthetic or value preservation.

SUMMARY

The invention includes a furniture glide that can be mounted on the foot of a furniture leg. The furniture glide is constructed around a glide base having an inner portion and foot support surface. A plurality of spring fingers positioned on the glide base have attached and distal ends, with the attached end of each spring finger being connected to the glide base. The distal ends extend in an inward direction toward the inner portion of the glide base. The distal ends also extend in an outward direction away from the foot support surface.

A head is positioned at about the distal end of each spring finger. The positioning of each head allows the heads and spring fingers to receive an outward expansion force from the foot when the foot is moved toward the foot support surface of the glide base. The outward expansion force against the spring fingers is in a direction that is away from the inner portion of the glide base.

The spring fingers are positioned to move in an inward direction toward the inner portion of the glide base when the foot contacts the foot support surface of the glide base. The movement of the spring fingers in the inward direction engages and locks the foot to the furniture glide. Movement of the spring fingers toward the inner portion of the glide base may be effected by the bias of the flexible memory shape of the spring fingers or mechanical actuation such as a spring, by contact or weight actuation such as contact of the foot against the foot support surface, or by other appropriate methods of actuation. In some embodiments, shear forces between the foot and foot support surface provide for additional engagement forces between the foot and furniture glide, especially when the furniture glide is moved across a floor.

Those skilled in the art will realize that this invention is capable of embodiments that are different from those shown and that details of the structure of the disclosed furniture glide can be changed in various manners without departing from the scope of this invention. Accordingly, the drawings and descriptions are to be regarded as including such equivalent furniture glides as do not depart from the spirit and scope of the invention.

BRIEF DESCRIPTION OF THE DRAWINGS

For a more complete understanding and appreciation of this invention, and many of its advantages, reference will be made to the following detailed description taken in conjunction with the accompanying drawings.

DETAILED DESCRIPTION

Figure 1A:
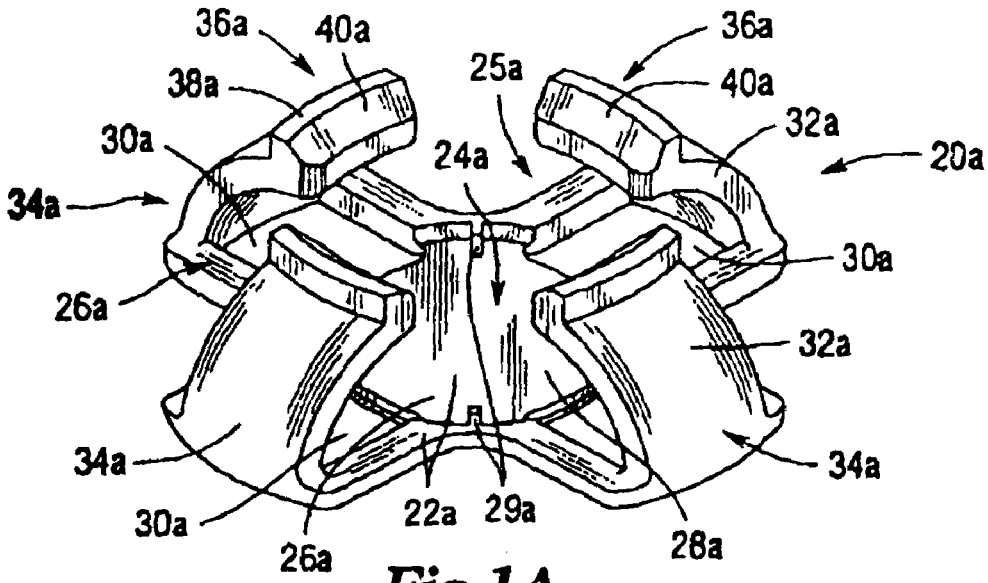
FIG. 1A is a perspective view of a furniture glide of the invention.

Referring to the drawings, similar reference numerals are used to designate the same or corresponding parts throughout the several embodiments and figures. Specific embodiment variations in corresponding parts are denoted with the addition of lower case letters and/or prime indicators to reference numerals.

Figure 1B:
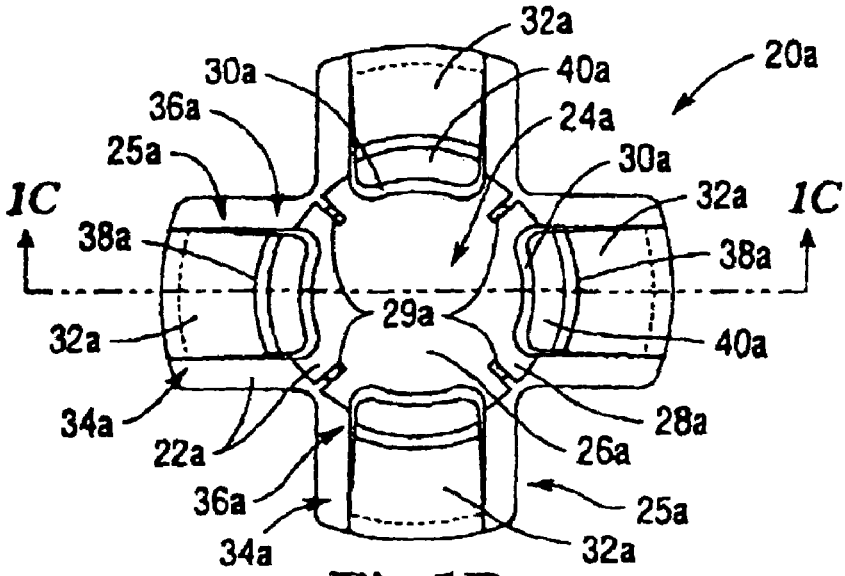
FIG. 1B is a top view of the furniture glide of FIG. 1.

FIG. 1A is a perspective view of a furniture glide 20*a* of the invention. FIG. 1B depicts a top view and FIG. 5C depicts a side cross sectional view of the furniture glide 20*a* of FIG. 1, along cross sectional line 1C-1C of FIG. 1B. A glide base 22*a* of the furniture glide 20*a* includes an inner portion 24*a*, an outer portion 25*a*, and a foot support surface 26*a*. The foot support surface 26*a* includes an indentation 28*a* at about the inner portion 24*a*, the indentation 28*a* typically shaped to accommodate a foot (not shown in FIGS. 1A-C). Services 29*a* positioned along the perimeter of the indentation 28*a* allow for slight variations in the sizes of different feet that may be accommodated by the indentation 28*a*.

The outer portion 25*a* of the glide base 22*a* includes cutaway slots 30*a* which allow for reductions in weight and the amount of material required for manufacturing the furniture glide 20*a* without significantly reducing its strength, durability and utility. If the furniture glide 20*a* is constructed of a polymer material such as plastic, the cutaway slots 30*a* can also facilitate the design and operation of plastic injection tooling used in the manufacturing of the furniture glide 20*a*.

Four spring fingers 32*a* are located about equidistantly from each other in 90-degree increments on the outer portion 25*a* of the glide base 22*a*. Each spring finger 32*a* includes an attached end 34*a* that is connected to the glide base 22*a*. Each spring finger 32*a* also includes a distal end 36*a* that extends in an inward direction toward the inner portion 24*a* of the glide base 22*a* and that also extends in an outward, arcuate direction away from the foot support surface 26*a*. A head 38*a* is positioned at the distal end 36*a* of each spring finger 32*a* and includes an angled surface 40*a* for contacting the foot and receiving an expansion force as the foot is moved toward the foot support surface 26*a*. Each spring finger 32*a* is molded or formed to the glide base 22*a* of the furniture glide 20*a* so that the furniture glide 20*a* generally comprises a single, flexible furniture glide assembly. The material of the furniture glide 20*a* will also generally be of a flexible material having a memory shape, the memory shape causing each of the spring fingers 32*a* to be biased to a position (as shown in FIGS. 1A-B) that allows for the engagement and locking of the foot to the furniture glide 20*a* when the foot contacts the foot support surface 26*a*.

Figure 1C:
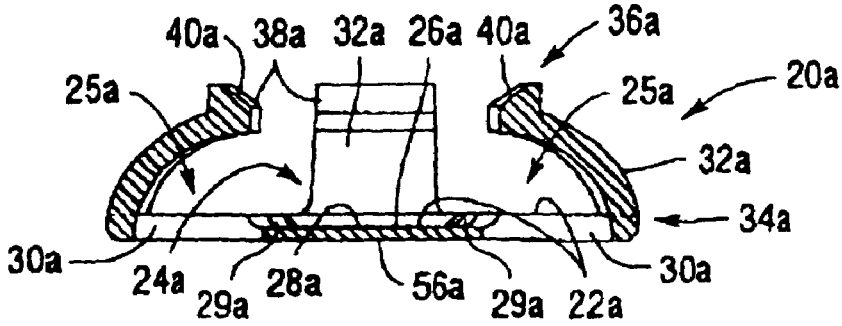
FIG. 1C is a side, cross sectional view of the furniture glide of FIG. 1, taken along line 1C-1C of FIG. 1B.
Figure 2A:
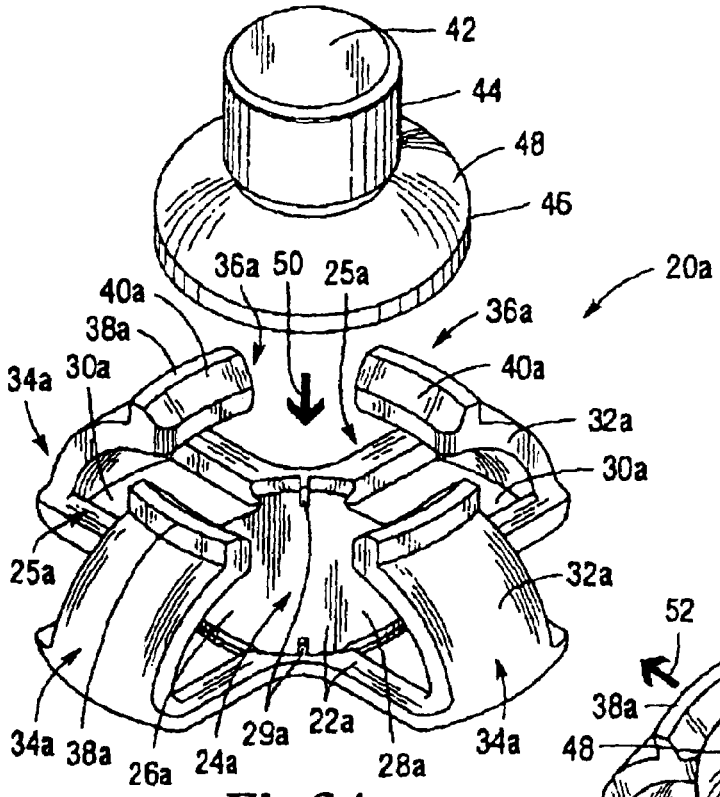
FIG. 2A is a perspective view of the furniture glide of FIG. 1 with a foot shown prior to engagement by the furniture glide.
Figure 2B:
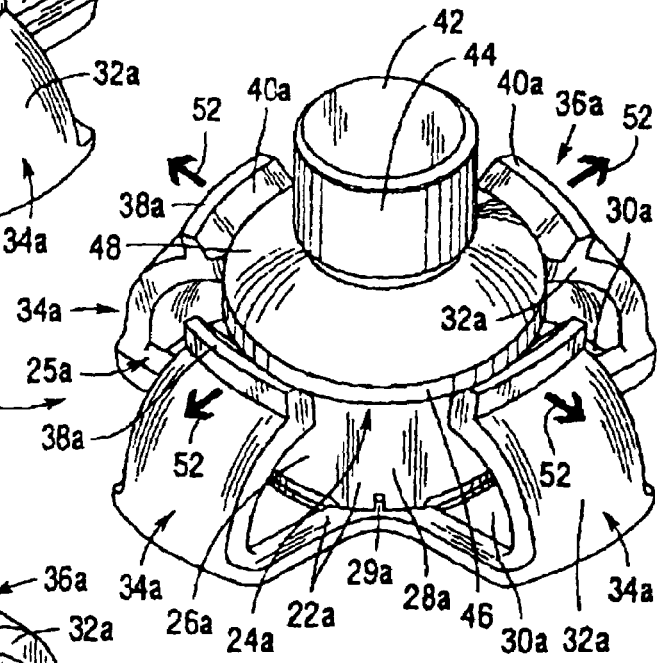
FIG. 2B is a perspective view of the furniture glide of FIG. 1 with a foot being moved toward the foot support surface of the furniture glide.
Figure 2C:
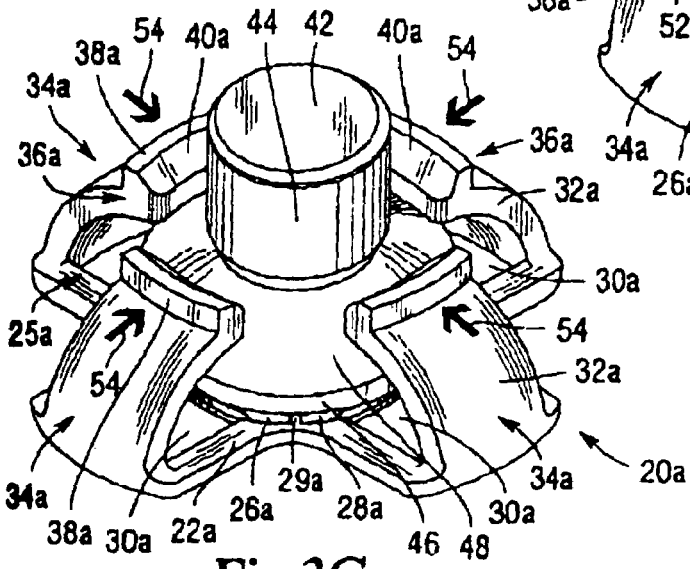
FIG. 2C is a perspective view of the furniture glide of FIG. 1 after a foot has been engaged and locked by the furniture glide.

Engagement of a foot by the furniture glide 20*a* can best be understood with reference to FIGS. 2A-C, which together depict the furniture glide 20*a* of FIGS. 1A-C as a foot 42 is moved toward and contacts the foot support surface 26*a*. As best understood with reference to FIG. 2A, the foot 42 includes a connector 44, an expanded portion 46, and an upper expanded surface 48. To attach the furniture glide 20*a* to the foot 42, the foot 42 is moved in a downward direction 50, the expanded portion 46 of the foot 42 being oriented toward the angled surfaces 40*a* of each head 38*a* of the spring fingers 32*a*. The clearance between each of the heads 38*a* is smaller than the expanded portion 46 of the foot 42, causing the foot 42 to contact at least one or more of the heads 38 as the foot 42 is moved toward the foot support surface 26*a*. FIG. 2B depicts the foot 42 as the expanded portion 46 contacts the angled surfaces 40*a* of each head 38*a*, each spring finger 32*a* receiving an expansion force in outward direction 52 away from the inner portion 24*a* of the glide base 22*a* as the foot 42 continues to move toward the foot support surface 26*a*. The outward directions 52 of the outward expansion forces are against the bias of the spring fingers 32*a* created by the memory of the spring fingers, the memory shape being depicted in the view of the furniture glide 20*a* depicted in FIG. 2A.

Referring now to FIG. 2C, as the foot 42 continues to move toward and contact the foot support surface 26*a*, the expanded portion 46 passes and clears the inwardly extending distal ends 36*a* of the spring fingers 32*a* so that the upper expanded surface 48 of the expanded portion 46 of the foot 42 is beneath the heads 38*a* and distal ends 36*a* of the spring fingers 32*a*. Due to the memory shape of the spring fingers 32*a*, the spring fingers 32*a* move in inward directions 54 toward the inner portion 24*a* of the glide base 22*a*. This places the heads 38*a* and distal ends 36*a* of the spring fingers 32*a* over the upper expanded surface 48 of the foot's expanded portion 46, resulting in the engagement and locking the foot 42 to the furniture glide 20*a* as the foot 42 contacts the foot support surface 26*a*. If the foot 42 also bears the partial or full load of a furniture piece and/or items or occupants thereon, the additional load will be exerted against the foot support surface 26*a*, which can have the effect of further forcing the spring fingers 32*a* toward the inner portion 24*a* of the glide base 22*a*, further locking the foot 42 to the furniture glide 20*a*.

As best understood by comparing FIGS. 1A-C with FIGS. 2A-C, the foot support surface 26*a* is generally shaped to accommodate the foot 42, and may entirely accommodate the foot 42 within the indentation 28*a*. This partial or full accommodation of the foot 42 contributes to the exertion of shear forces by the glide base 22*a* against the foot 42 when a furniture leg (not shown) attached to the foot 42 is loaded with the full or partial weight of a piece of furniture and dragged across a floor, reducing laterally-exerted forces against one or more individual spring fingers 32*a* and providing for additional engagement forces between the foot and glide clip. In some embodiments, a high-friction material may be added to an indentation or another portion of a foot support surface to further increase shear forces of a foot against the foot support surface.

Furniture glides of the invention will typically comprise a material that is suitable for contacting a surrounding floor. The selection of such materials will typically partially depend on whether it is desirable for a piece of furniture having furniture glides to be movable or stationary. If the selected material of the furniture glide is not sufficiently suited for contacting the surrounding floor, another material may be added to the furniture glide. For example, referring briefly to FIG. 1C, a low-friction floor contact surface 56*a* is added to the glide base 22*a* of the furniture glide 20*a* to contact a surrounding floor and to reduce frictional resistance when the furniture glide 20*a* is dragged across the floor while bearing the load of a piece of furniture. The floor contact surface 56*a* will, depending on the floor type with which it is intended to be used, typically be of a friction-resistant material such as plastic, Teflon, polymer composite, or other suitable material. If the selected material of the furniture glide 20*a* is itself suitable for producing low resistance against a particular surrounding floor type, the floor contact surface 56*a* may also be comprise a segment of the material structure of the glide base

22*a*. The floor contact surface 56*a* may also typically comprise a material such as felt, rubber, or soft plastic that will minimize damage to the surrounding floor type when the attached piece of furniture is dragged or used in a stationary location. The material of the floor contact surface 56*a* may also be chosen for its ability to minimize noise when the furniture glide 20*a* is dragged while under load.

Although the invention has been shown and described as having a floor contact surface that is suited for minimizing frictional resistance against a surrounding floor, it will be appreciated that some embodiments of the invention may incorporate a high-friction producing material where it is desirable for a piece of furniture to be stationary, more stable, or not easily movable across a surrounding floor. For example, the floor contact surface 56*a* depicted in FIG. 1C could be substituted with a high friction-producing material to prevent movement of an attached furniture piece. Such suitable materials could include rubber, velcro, selected polymer composites, and other materials having relatively high coefficients of friction. The use of such high-friction producing materials is contemplated to be within the intended scope of the invention.

Figure 3A:
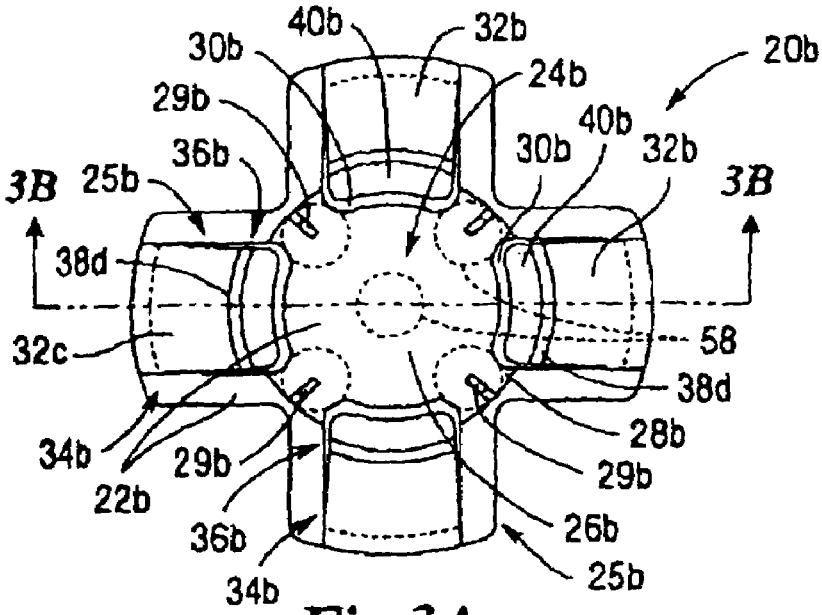
FIG. 3A is a top view of a furniture glide of the invention.
Figure 3B:
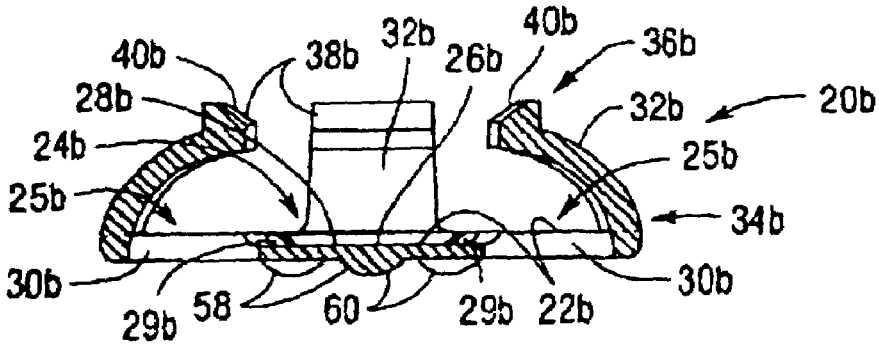
FIG. 3B is a side, cross sectional view of the furniture glide of FIG. 3A, taken along line 3B-3B of FIG. 3A.

It will be further appreciated that different structural arrangements can also be used to provide contact between a furniture glide of the invention and a surrounding floor. For example, FIG. 3A is a top view of a furniture glide 20*b* of the invention having multiple floor contact blisters 58 located on the glide base 22*b* below the indentation 28*b*. FIG. 3B depicts a side cross sectional view of the furniture glide 20*b* along line 3B-3B of FIG. 3A. A bottom view of the furniture glide 20*b* is depicted in FIG. 3C.

Figure 3C:
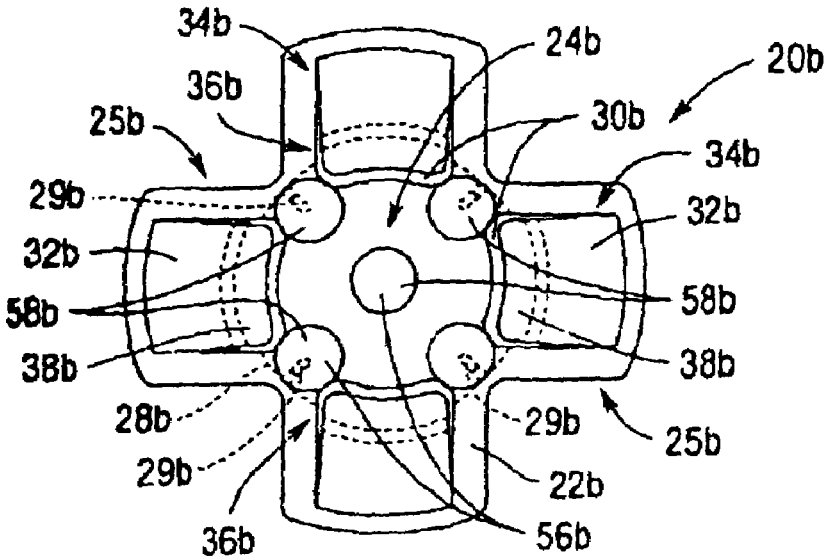
FIG. 3C is a bottom view of the furniture glide of FIG. 3A.

As best understood by comparing FIG. 3B to FIGS. 3A and 3C, the blisters 58 are smooth and rounded in shape so that a relatively small surface area of each blister 58 actually makes contact with a floor. The smooth shape of the blisters 58 combined with the combined, reduced surface area of the furniture glide 20*b* that contacts the floor substantially reduces friction to enable a piece of furniture to be easily moved when the furniture glide 20*b* is moved across a floor. The blisters 58 will also typically comprise a material that will minimize damage to the floor and/or minimize noise that results when the furniture glide 20*b* is moved across the floor. The blisters 58 can be part of the single, integral assembly of the furniture glide 20*b* or be part of a floor contact element that is attached to the glide base 22*b* with either a structural or adhesive connection.

Figure 4A:
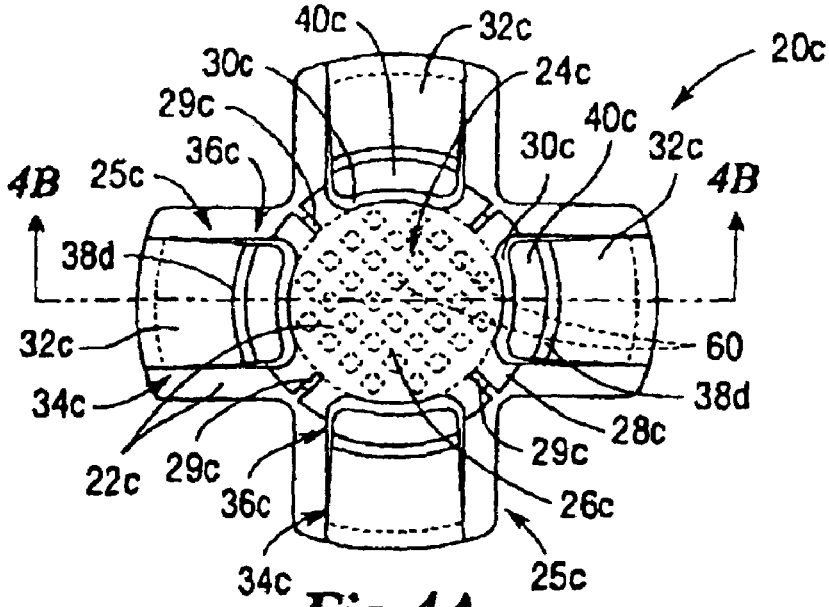
FIG. 4A is a top view of a furniture glide of the invention.
Figure 4B:
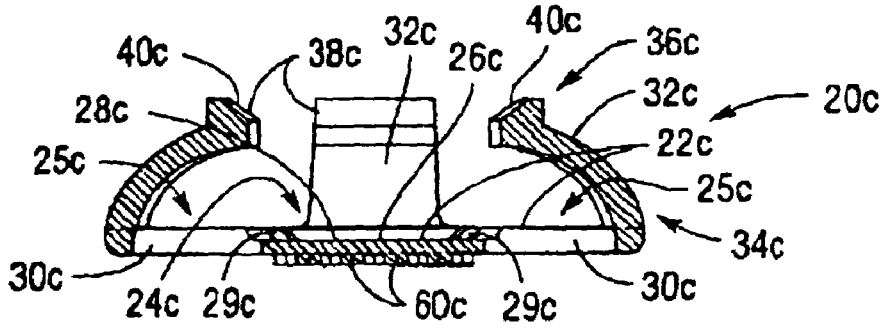
FIG. 4B is a side, cross sectional view of the furniture glide of FIG. 4A, taken along line 4B-4B of FIG. 4A.
Figure 4C:
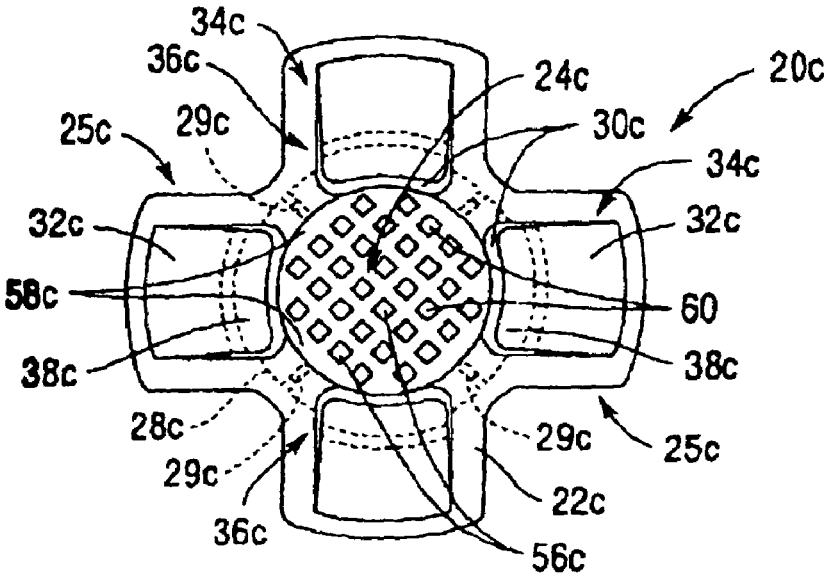
FIG. 4C is a bottom view of the furniture glide of FIG. 4A.

FIG. 4A is a top view of a furniture glide 20*c* of the invention having a floor contact surface 56*c* that is dimpled below the indentation 28*c*. FIG. 4B depicts a side cross sectional view of the furniture glide 20*c* along line 4B-4B of FIG. 4A. A bottom view of the furniture glide 20*c* is depicted in FIG. 4C. The dimples 60 reduce the amount of surface area of the floor contact surface 56*c* that makes contact with a floor, substantially reducing friction to enable a piece of furniture to be easily moved when the furniture glide 20*b* is moved across the floor. The dimpled floor contact surface 56*c* can also be part of the single, integral assembly of the furniture glide 20*c* or be part of a floor contact element that is attached to the glide base 22*c* with either a structural or adhesive connection.

Figure 5A:
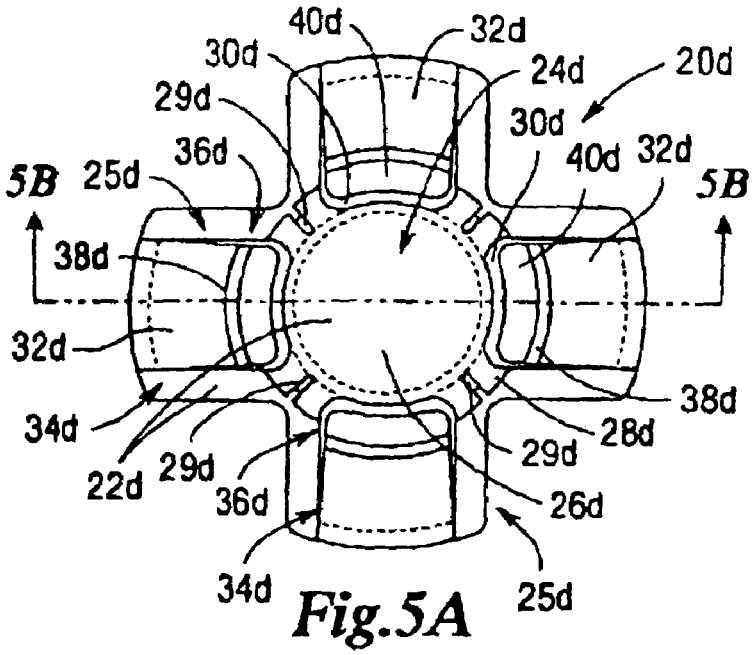
FIG. 5A is a top view of a furniture glide of the invention.
Figure 5B:
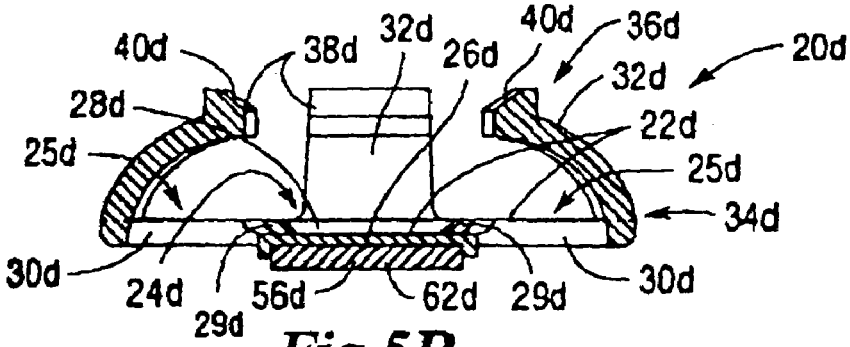
FIG. 5B is a side, cross sectional view of the furniture glide of FIG. 5A, taken along line 5B-5B of FIG. 5A.
Figure 5C:
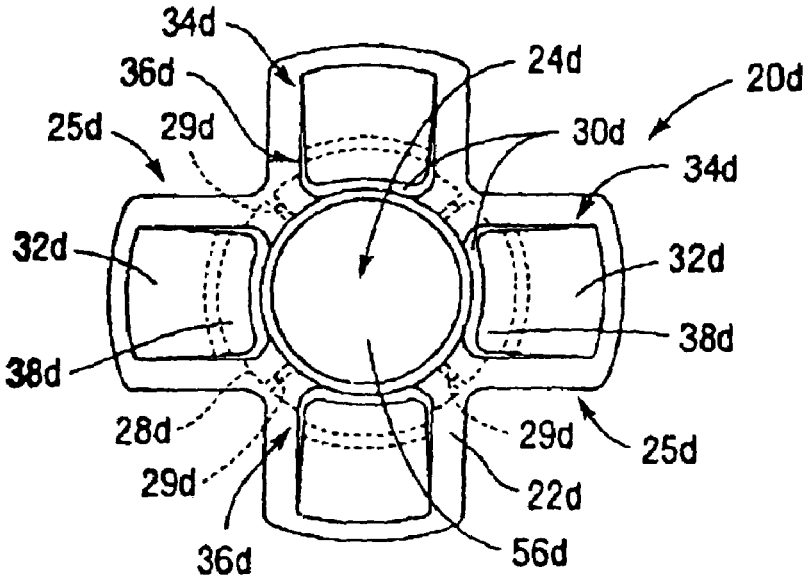
FIG. 5C is a bottom view of the furniture glide of FIG. 5A.

FIGS. 5A-C depict an example of such an adhesive connection between a glide base 22*d* and a floor contact surface 56*d*. As best understood by comparing the top and bottom views of FIGS. 5A and 5C with the side cross sectional view of FIG. 5B, The floor contact surface 56*d* is bonded to the glide base 22*d* below the indentation 28*d* and against an adhesion surface 62*d*. The bond between the floor contact surface 56*d* and adhesion surface may be created with an epoxy, glue, or other appropriate adhesive that is suited for the material of the floor contact surface 56*d*. Such an adhesive or bonded connection between the floor contact surface 56*d* and glide base 22*d* may be optimal where the floor contact surface 56*d* is intended to minimize noise and damage when the furniture glide 20*d* is dragged across a floor. For example, bonded felt may be used as the floor contact surface 56*d* where a piece of furniture is to be positioned on or dragged across a hard, uncarpeted floor to reduce friction while the furniture glide 20*d* engages a foot (not shown in FIGS. 5A-C). In such an application, it may be undesirable to have contact surface attachment hardware, such as screws or rivets, positioned where the hardware could be exposed to contact the floor.

Figure 6A:
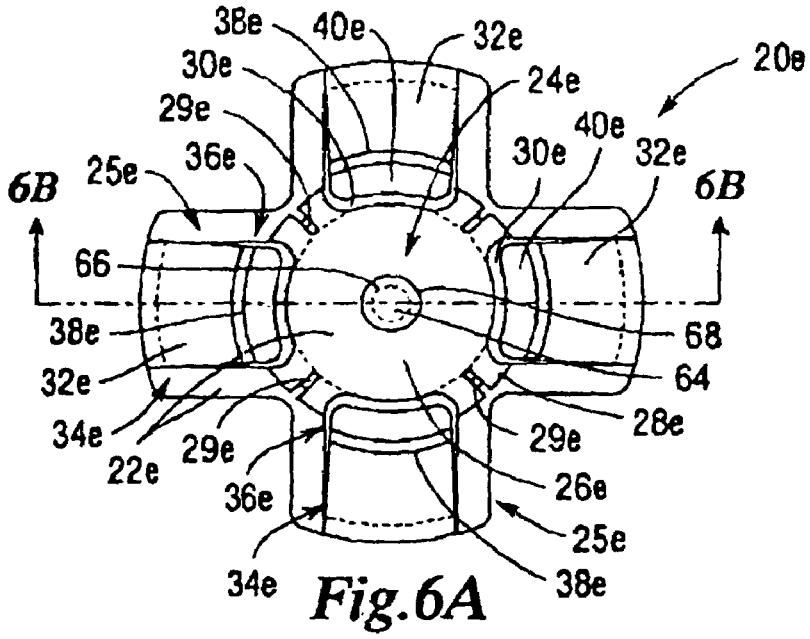
FIG. 6A is a top view of a furniture glide of the invention.
Figure 6B:
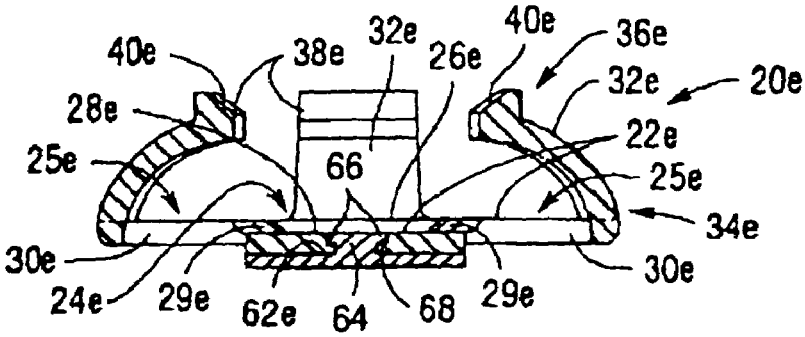
FIG. 6B is a side, cross sectional view of the furniture glide of FIG. 6A, taken along line 6B-6B of FIG. 6A.
Figure 6C:
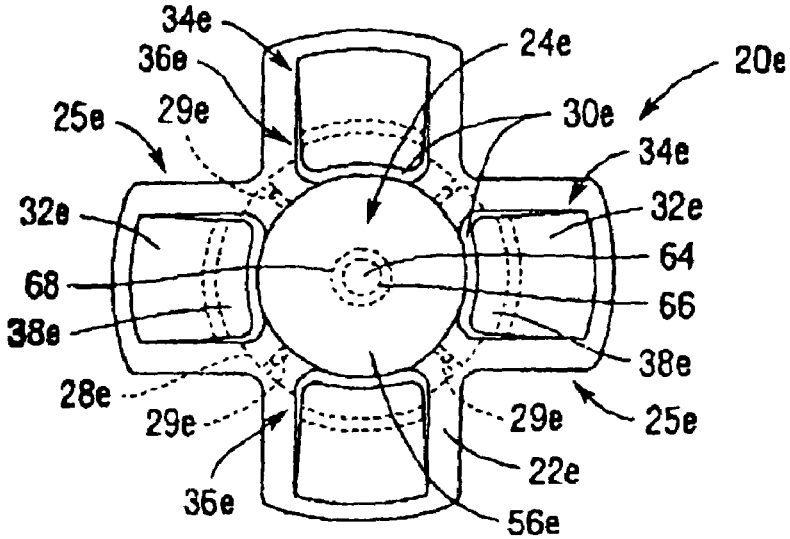
FIG. 6C is a bottom view of the furniture glide of FIG. 6A.

A floor contact surface can also be attached to a furniture glide of the invention mechanically or by a combination of mechanical and adhesive or bonded attachments. For example, FIGS. 6A-C depict a furniture glide 20*e* having a button connector 64 which is an structural extension from the floor contact surface 56*e* that extends through the glide base 22*e* and locks the floor contact surface 56*e* to the foot support surface 26*e* with an expanded button portion 66. A best understood by comparing the side cross sectional view of FIG. 6B with the top and bottom views of FIGS. 6A and 6B, the expanded button portion 66 fits within a button recess 68 so that the top of the expanded button portion 66 remains flush with the indentation 28*e* of the foot support surface 26*e*, enabling the floor contact surface 56*e* to be securely fastened to the furniture glide 20*e* without interfering with the engagement of a foot (not shown in FIGS. 6A-C) or the bearing of the foot's load. Optionally, the addition of an adhesive to an adhesive surface 63*e* can further secure the foot support surface 26*e* to the furniture glide 20*e*.

Although the invention has been shown and described with a button connector, it will be appreciated that other types of mechanical connections are also possible and are within the intended scope of the invention. Other such types of mechanical connections include undercuts, dovetail connections, connections using hardware such as screws, rivets, and foots, and other appropriately implemented types of connectors.

Figure 7A:
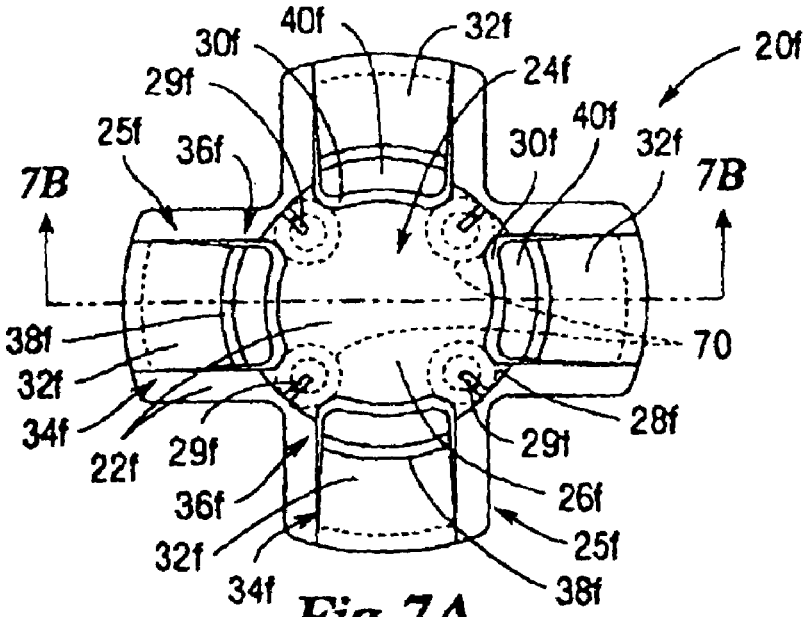
FIG. 7A is a top view of a furniture glide of the invention.
Figure 7B:
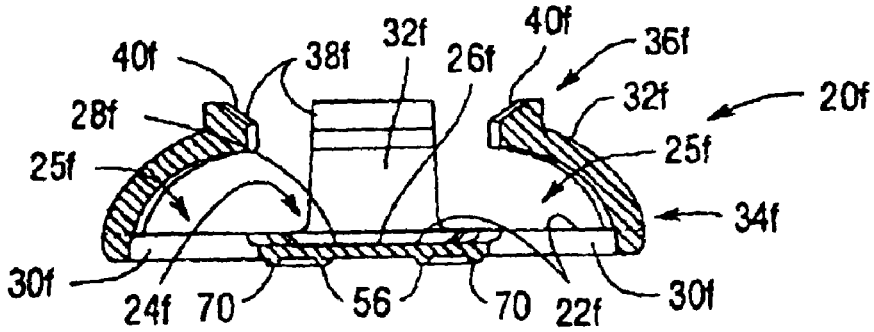
FIG. 7B is a side, cross sectional view of the furniture glide of FIG. 7A, taken along line 7B-7B of FIG. 7A.
Figure 7C:
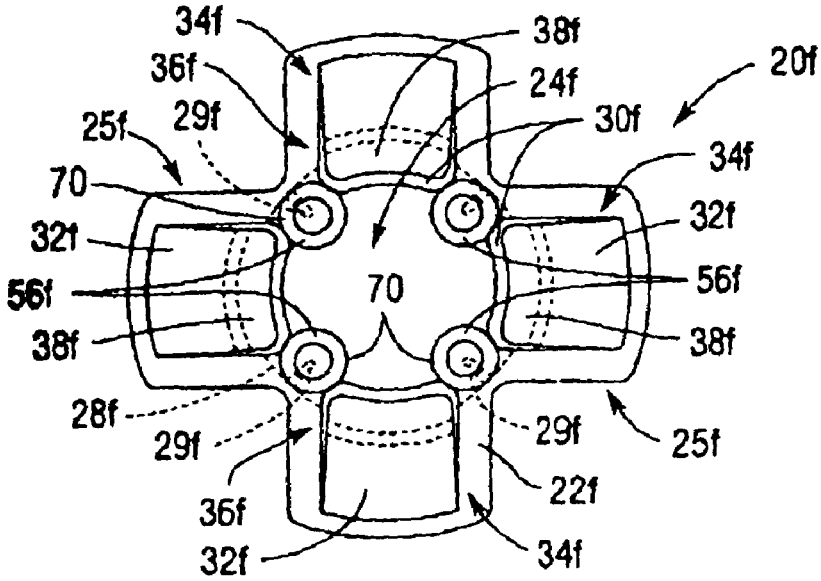
FIG. 7C is a bottom view of the furniture glide of FIG. 7A.

Referring now to FIGS. 7A-C, a furniture glide 20*f* of the invention includes multiple donut dimples 70 located on the glide base 22*f* below the indentation 28*f*. FIG. 7B depicts a side cross sectional view of the furniture glide 20*f* along line 7B-7B of FIG. 7A. A bottom view of the furniture glide 20*c* is depicted in FIG. 7C.

As best understood by comparing FIG. 7B to FIGS. 7A and 7C, the donut dimples 70 have smooth and rounded circular shapes so that a relatively small surface area of each donut dimple 70 actually makes contact with a floor while the furniture glide 20*f* bears a load. The smooth shape of the donut dimples 70 combined with resulting reduced surface area of the floor contact surface 56*f* that contacts the floor substantially reduces friction to enable a piece of furniture to be easily moved when the furniture glide 20*f* moves across a floor. The donut dimples 70 also typically comprise a material that minimizes damage to the floor and/or minimizes noise that results when the furniture glide 20*f* is moved across the floor. The donut dimples 70 can be part of the single, integral assembly of the furniture glide 20*f* or be part of a floor contact element that is attached to the glide base 22*f* with either a structural or adhesive connection.

Figure 8A:
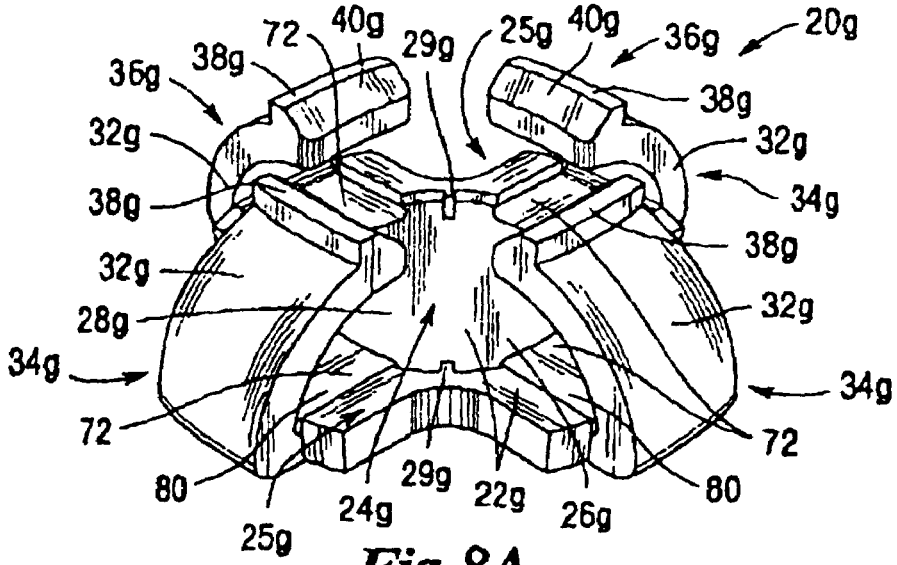
FIG. 8A is a perspective view of a furniture glide of the invention.

Although the invention has been shown and described as having spring fingers that are molded into a single, flexible furniture glide assembly where the fingers are biased toward the inner portion of a glide base due to the memory shape of the furniture glide material, it will be appreciated that some embodiments of the invention allow for the receipt of expansion forces and for inward and outward movement of each spring finger using other configurations. For example, FIG. 8A is a perspective view of a furniture glide 20*g* of the invention in which the attached end 34*g* of each spring finger 32*g* includes a pivot extension 72 extending inward into a cutaway slot 30*g* toward the inner portion 24*g* of the glide base 22*g*. As best understood by comparing the top view of the furniture glide 20*g* in FIG. 8B with the cross sectional side view of the furniture glide 20*g* in FIG. 8C, each spring finger 32*g* is pivotally mounted on the glide base 22*g* with a pivot 74 that extends through the pivot extension 72. An underside 76*g* of each pivot extension 72 is positioned to contact and remain flush with a floor when the furniture glide 20*g* is positioned on the floor.

Figure 8B:
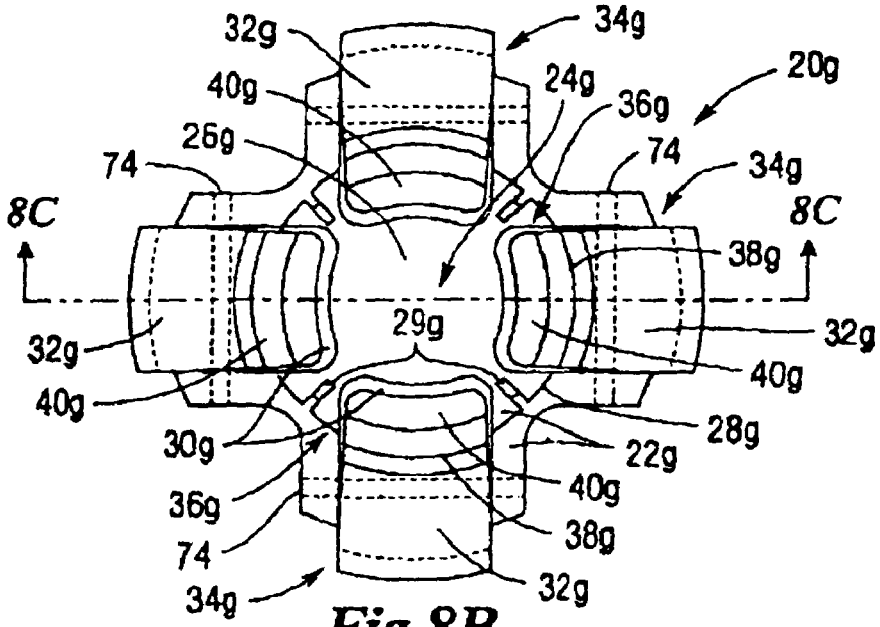
FIG. 8B is a top view of the furniture glide of FIG. 8A.
Figure 8C:
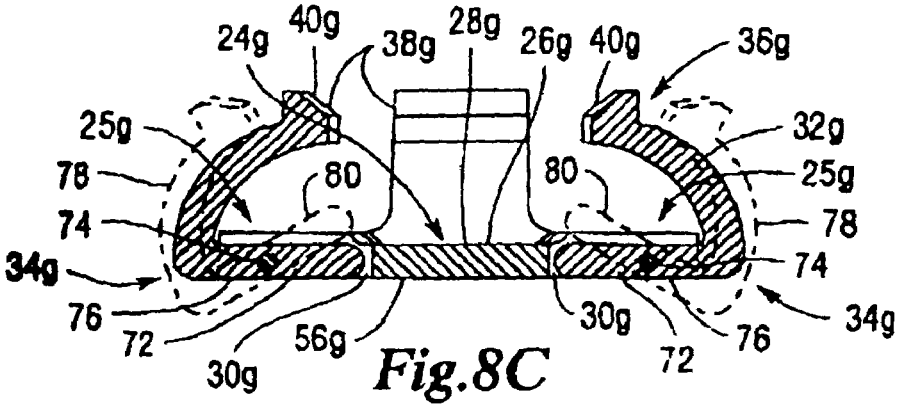
FIG. 8C is a side, cross sectional view of the furniture glide of FIG. 8A, taken along line 8C-8C of FIG. 8B.

Operation of the furniture glide 20*g* is best understood by first referring to FIGS. 8A and 8B. When a foot (not shown in FIGS. 8A-C) is moved toward the heads 38*g* of the spring fingers 32*g*, the foot contacts the angled surface 40*g* of each head 38*g* to exert an outward expansion force against the spring fingers 32*g*. Referring now to the side cross sectional view of FIG. 8C, the spring fingers 32*g* accordingly move in an outward direction, moving on the pivots 74 via the pivot extensions 72, as shown with the broken outlines 78. This creates a clearance between the heads 38*g* of the spring fingers 32*g* which is sufficient for the foot to pass below the heads 38*g* and move toward the foot support surface 26*g* of the glide base 22*g*.

As the foot continues to move toward the foot support surface 26*g*, the foot will typically be sufficiently wide to contact top sides 80 of the pivot extensions 72 of each spring finger 32*g*, gathering the spring fingers 32*g* and forcing the fingers 32*g* to rotate on their pivots 74 so that the distal end 36*g* and head 38*g* of each spring finger 32*g* moves inward toward the inner portion 24*g* of the glide base 22*g* until the foot contacts the foot support surface 26*g*. This positions each spring finger 32*g* over the foot, locking the foot to the furniture glide 20*g*. If the furniture glide 20*g* is positioned on the floor, the load of the leg attached to the foot will exert additional force against the foot support surface 26*g*, causing the floor contact surface 56*g* to contact the floor. This will force the underside 76*g* of each pivot extension 72 to become flush with the floor, further locking the foot to the furniture glide 20*g*.

Figure 9A:
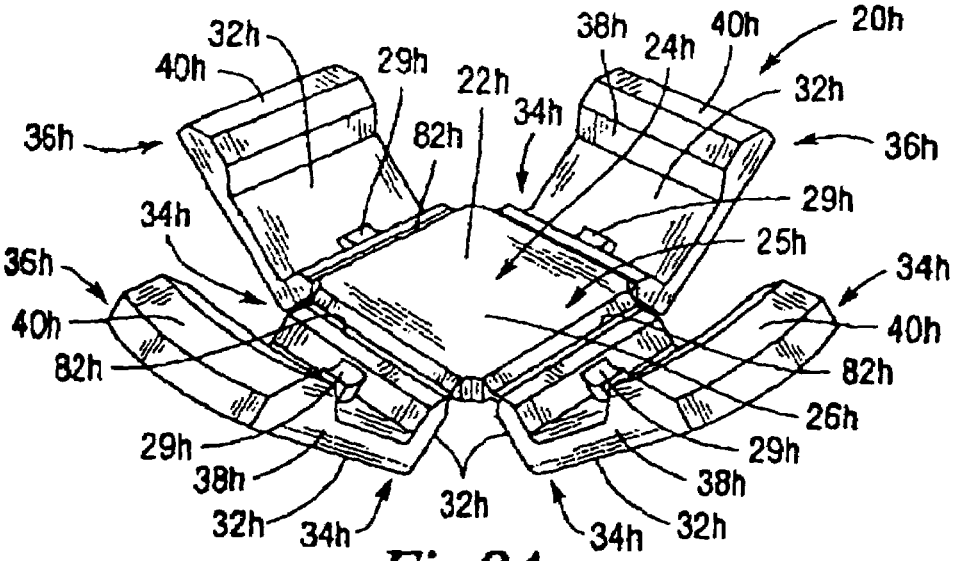
FIG. 9A is a perspective view of a furniture glide of the invention.
Figure 9B:
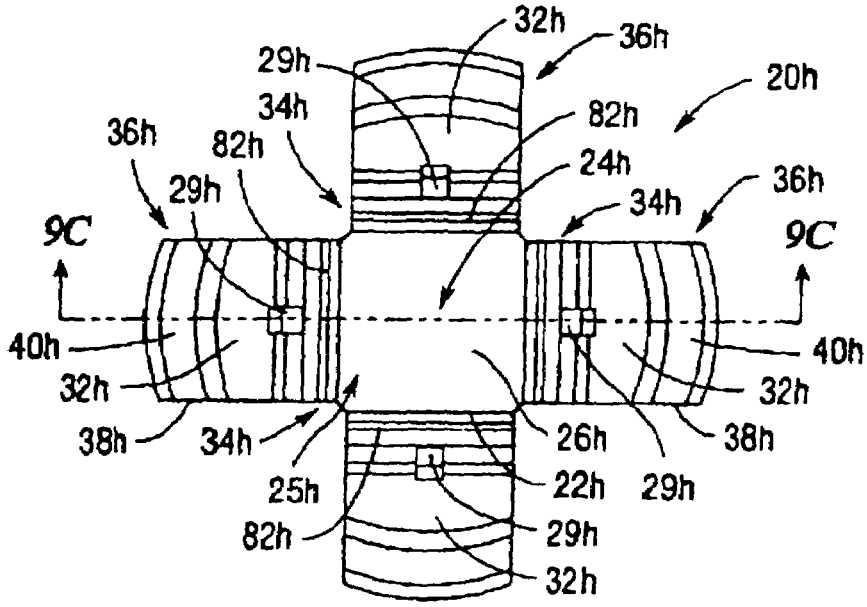
FIG. 9B is a top view of the furniture glide of FIG. 9A.
Figure 9C:
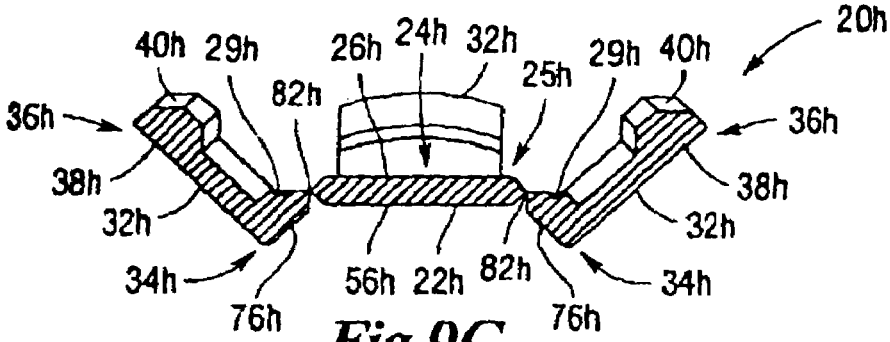
FIG. 9C is a side, cross sectional view of the furniture glide of FIG. 9A, taken along line 9C-9C of FIG. 9B.

FIGS. 9A-C depict a furniture glide 20*h* of the invention in which the inward and outward movement of each spring finger 32*h* is permitted through the use of a living hinge 82*h*. The furniture glide 20*h* is preferably constructed of a flexible material such as plastic or spring metal and is formed into a single, flexible furniture glide assembly. The distal ends 36*h* of the spring fingers 32*h* extend in an inward direction toward the inner portion 24*h* of the glide base 22*h*. Each living hinge 82*h* is formed by a thinness of the material of the furniture glide 20*h* between the glide base 22*h* and attached ends 34*h* of the spring fingers 32*h*, allowing each of the spring fingers 32*h* to pivot on the living hinges 82*h* and move in both an inward direction toward the inner portion 24*h* of the glide base 22*h* and in an outward direction away from the inner portion 24*h* of the glide base 22*h*. An underside 76*h* at each attached end 34*h* of each spring finger 32*h* is positioned to contact and remain flush with a floor when the furniture glide 20*g* is positioned on the floor.

Operation of the furniture glide 20*h* is best understood by comparing the perspective and cross sectional views of FIGS. 9A and 9C with the top view of FIG. 9B. When a foot (not shown in FIGS. 9A-C) is moved toward the heads 38*h* of the spring fingers 32*h*, if the distances between the heads 38*h* of the spring fingers 32*h* are not sufficient to allow the foot to pass therebetween, the foot contacts the angled surface 40*h* of one or more heads 38*h* to exert an outward expansion force against the spring fingers 32*h*. Referring now to the side cross sectional view of FIG. 9C, the spring fingers 32*h*, if contacted by the foot, move responsively in an outward direction, pivoting on the living hinges 82. This creates a clearance between the heads 38*h* of the spring fingers 32*h* sufficient for the foot to pass below the heads 38*h* and move toward the foot support surface 26*h* of the glide base 22*h*. As the foot contacts the foot support surface 26*h*, services 29*h* positioned on the attached ends 34*h* of each spring finger 32*h* allow for slight variations in the sizes of feet accommodated by the foot support surface 26*h*.

If the furniture glide 20*h* is positioned on a floor, the load of the leg attached to the foot exerts a force against the foot support surface 26*h*, causing the floor contact surface 56*h* to contact the floor. This forces the underside 76*h* of each spring finger 32*h* to become flush with the floor, forcing the distal ends 36*h* and heads 38*h* of the spring fingers 32*h* in a direction that is toward the inner portion 24*h* of the glide base 22*h*, locking the foot to the furniture glide 20*h*.

Figure 10A:
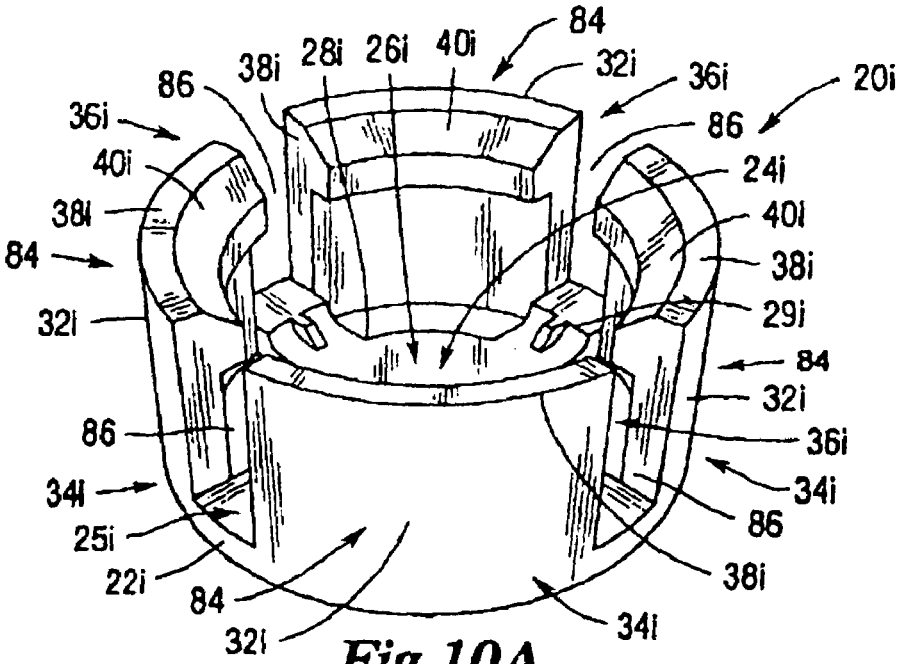
FIG. 10A is a perspective view of a furniture glide of the invention.
Figure 10B:
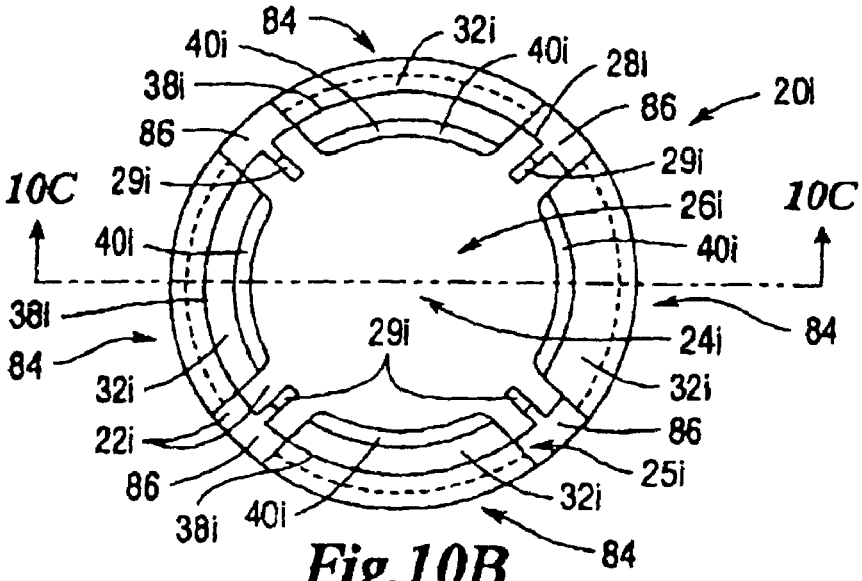
FIG. 10B is a top view of the furniture glide of FIG. 10A.
Figure 10C:
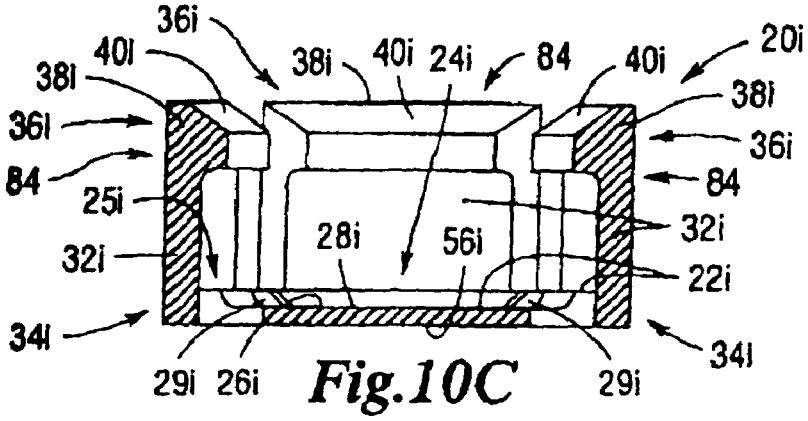
FIG. 10C is a side, cross sectional view of the furniture glide of FIG. 10A, taken along line 10C-10C of FIG. 10B.

It will be appreciated that some embodiments of the invention can be constructed from a single stamped or molded assembly omitting cutaway slots. Spring fingers can also be constructed to occupy substantial portions of an arcuate perimeter around a glide base. For example, FIGS. 10A-C depict a glide base 20*i* of the invention having expanded spring fingers 32*i* that extend along quadrants 84 of the perimeter of the glide base 22*i*, each spring finger 32*i* being separated from two adjacent spring fingers 32*i* with a narrow quadrant notch 86. No cutaway slots extend through the glide base 22*i*. The distal end 36*i* of each spring finger 32*i* extends in an inward direction toward the inner portion 24*i* of the glide base 22*i*. The entire assembly of the furniture glide 20*i* is a single molded or stamped part made of a flexible material such as plastic or spring metal having a memory shape that causes the spring fingers 32*i* to move in an inward direction toward the inner portion 24*i* of the glide base 20*i* when a foot (not shown in FIGS. 10A-C) contacts the foot support surface 26*i*.

Figure 11A:
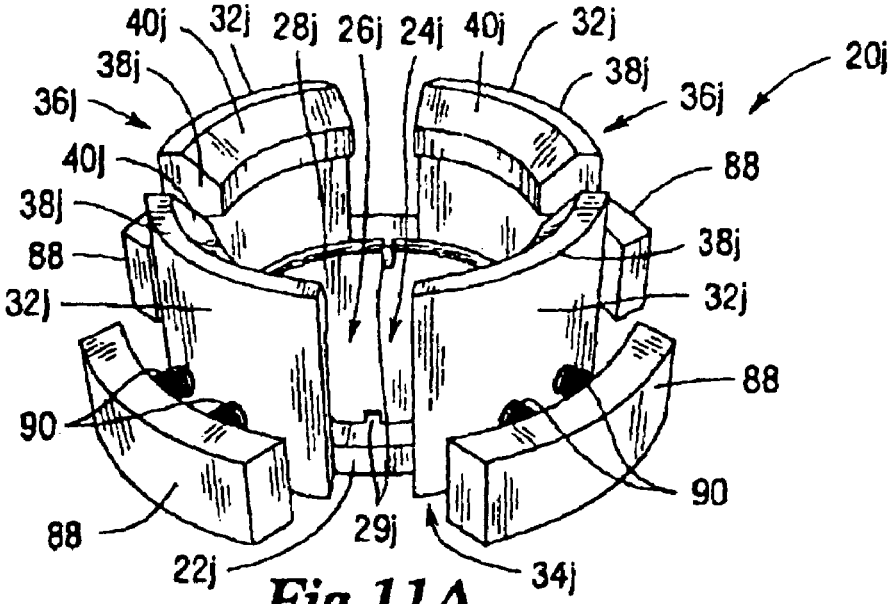
FIG. 11A is a perspective view of a furniture glide of the invention.

It will be further appreciated that some embodiments of the invention may incorporate a separate spring element to cause the spring fingers to move in an inward direction when a foot contacts the foot support surface of the furniture glide. For example, FIG. 11A depicts a furniture glide 20*j* of the invention having an expanded glide base 22*j* that includes back walls 88 which expand upward in a direction that is away from the foot support surface 26*j*. The distal end 36*j* of each spring finger 32*j* extends in an inward direction toward the inner portion 24*j* of the glide base 22*j*. Spring elements 90 extend between each spring finger 32*j* and one of the back walls 88, biasing the spring fingers 32*j* away from the back walls 88 and toward the inner portion 24*j* of the glide base 22*j*.

Figure 11B:
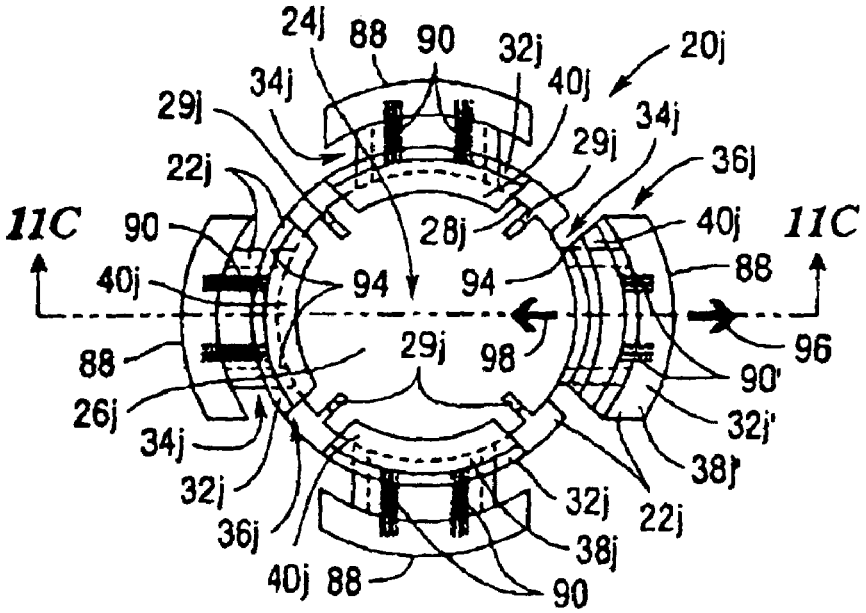
FIG. 11B is a top view of the furniture glide of FIG. 11A.
Figure 11C:
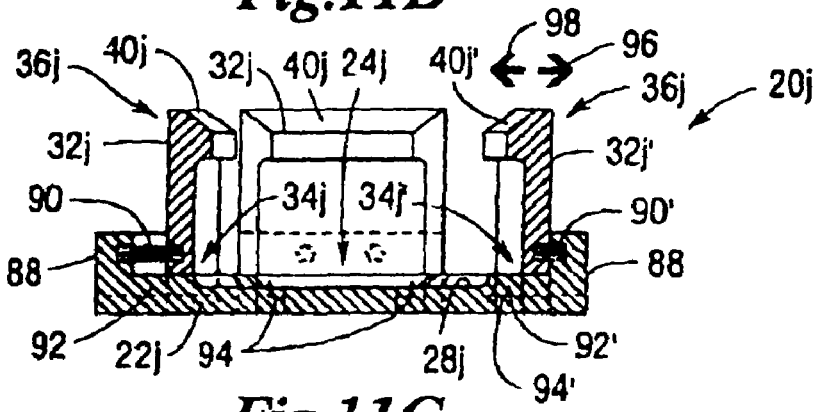
FIG. 11C is a side, cross sectional view of the furniture glide of FIG. 11A, taken along line 11C-11C of FIG. 11B.

Referring now to the top and side cross sectional views of the furniture glide 20*j* in FIGS. 11B and 11C, the engagement of a foot (not shown in FIGS. 11A-C) by the furniture glide 20*j* is described with a comparison of one spring finger 32*j*' and it's associated elements, each denoted with an element number having a prime indicator (e.g. 90'), that are depicted as if the spring finger 32*j*' is receiving an expansion force from a foot that is being moved toward the foot support surface 26*j*. The remaining spring fingers 32*j* and associated elements, not having prime indicators, are depicted as if no expansion force is being received.

Each spring finger 32*j* includes a dovetail extension 92 or 92', attached to the attached end 34*j* or 34*j*' of the spring finger

32*j* or 32*j*', which slidably connects the spring finger 32*j* or 32*j*' to the glide base 22*j* via a dovetail mounting 94 or 94'. When the foot is moved towards the foot support surface 26*j*, the foot contacts the angled surface 40*j* or 40*j*' of the spring finger 32*j* or 32*j*' and exerts an outward expansion force to move the spring finger 32*j* or 32*j*' on its dovetail mounting 94 or 94' in an outward direction 96 against the bias of the spring elements 90 or 90' toward the back wall 88 or 88'. In FIGS. 11B and 11C, the spring elements 90' are depicted as being compressed after the spring finger 32*j*' has itself fully moved away from the inner portion 24*j* of the glide base 22*j* and to the extent that the attached end 34*j*' of the spring finger 23*j*' is in contact with the back wall 88'. Once the foot passes below the head 38*j*' of the spring finger 23*j*', the spring finger 23*j*' moves on its dovetail mounting 94*j*' in an inward direction 98, under the biasing force of the spring elements 90', toward the inner portion 24*j* of the glide base 22*j*, to lock the foot to the furniture glide 20*j*, as depicted by the spring fingers 34*j*.

The invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A furniture glide for a foot of a piece of furniture comprising:

a planar glide base having a radially inner portion, a radially outer portion, and a foot support surface;

a plurality of spring fingers, each said spring finger formed integrally with and extending upwardly from said outer portion of said planar glide base and having an attached end connected to said outer portion of said glide planar base, each said spring finger having a distal end extending in an inward direction toward said inner portion of said planar glide base, each said distal end further extending in an outward direction away from said foot support surface;

a head positioned at about said distal end of each said spring finger, each said head being positioned to receive an outward expansion force from the foot to move at least one of said spring fingers in an outward direction away from said inner portion of said planar glide base when the foot is moved toward said foot support surface; and said spring fingers being positioned to move in an inward direction toward said inner portion of said glide base to engage and lock the foot to said furniture glide when the foot contacts said foot support surface.

2. The furniture glide of claim 1 wherein said spring fingers are comprised of four individual fingers connected at said attached ends to said planar glide base equidistantly in 90-degree increments.

3. The furniture glide of claim 1 further comprising a hole extending through said major planar dimension of said glide base, said hole having a hole diameter that is smaller than a foot diameter of the foot to prevent the foot from passing through said foot support surface.

4. The furniture glide of claim 1 wherein each of said spring fingers comprises an arcuately shaped finger made of a flexible material having a memory shape, said memory shape causing each of said spring fingers to move in an inward direction toward said inner portion of said glide base to engage and lock the foot to said furniture glide when the foot contacts said foot support surface.

5. The furniture glide of claim 1 wherein each of said spring fingers comprises an arcuately shaped finger made of a flexible, molded polymer material having a memory shape, said memory shape causing each of said spring fingers to move in an inward direction toward said inner portion of said planar glide base to engage and lock the foot to said furniture glide when the foot contacts said foot support surface.

6. The furniture glide of claim 1 wherein each of said spring fingers is spring biased toward said inner portion of said planar glide base, said spring bias causing each of said spring fingers to move in an inward direction toward said inner portion of said planar glide base to engage and lock the foot to said furniture glide when the foot contacts said foot support surface.

7. The furniture glide of claim 1 wherein each of said spring fingers are connected at said attached ends with hinges to said glide base and spring biased toward said inner portion of said glide base, causing said distal ends of each of said spring fingers to move in an inward direction toward said inner portion of said glide base to engage and lock the foot to said furniture glide when the foot contacts said foot support surface.

8. The furniture glide of claim 1 wherein each of said spring fingers is connected at said attached end with a living hinge to said glide base.

9. The furniture glide of claim 1 wherein each of said spring fingers is slidably positioned on said glide base and biased to an inward direction toward said inner portion of said glide base, each said finger being positioned to slidably move against its bias in an outward direction away from said inner portion of said glide base when the foot exerts an outward expansion force against said fingers.

10. The furniture glide of claim 1 further comprising a floor contact surface of planar said glide base that minimizes noise when said furniture glide drags against a floor while engaging the foot.

11. The furniture glide of claim 1 further comprising a floor contact surface of said planar glide base that minimizes damage to floor surfaces when said furniture glide drags against a floor while engaging the foot.

12. The furniture glide of claim 1 further comprising a floor contact surface of said glide base, said floor contact surface being dimpled to reduce friction against a floor when said furniture glide drags against the floor while engaging the foot.

13. The furniture glide of claim 1 wherein said glide base includes a plurality of floor contacting blisters that minimize friction when said furniture glide drags against a floor while engaging the foot.

14. The furniture glide of claim 1 wherein said glide base includes a plurality of donut dimples that minimize friction when said furniture glide drags against a floor while engaging the foot.

15. The furniture glide of claim 1 further comprising a floor contact surface of said glide base, said floor contact surface including felt to reduce friction against a floor when said furniture glide drags against the floor while engaging the foot.

16. The furniture glide of claim 1 further comprising a floor contact surface of said planar glide base, said floor contact surface including a low friction producing material that minimizes noise when said furniture glide drags against a floor while engaging the foot.

17. The furniture glide of claim 1 further comprising a floor contact surface of said planar glide base, said floor contact surface including a low-friction producing material that minimizes damage to floor surfaces when said furniture glide drags against a floor while engaging the foot.

18. The furniture glide of claim 1 further comprising a floor contact surface of said glide base, said floor contact surface including a low-friction producing material that is attached to said glide base with a dovetail fitting.

19. The furniture glide of claim 1 further comprising a floor contact surface of said glide base, said floor contact surface including a low-friction producing material that is attached to said glide base with an undercut fitting.

20. The furniture glide of claim 1 further comprising a floor contact surface of said glide base, said floor contact surface including a low-friction producing material that is mechanically attached to said glide base.

21. The furniture glide of claim 1 further comprising a floor contact surface of said planar glide base, said floor contact surface including a low-friction producing material that is adhesively attached to said planar glide base.

22. The furniture glide of claim 1 further comprising a floor contact surface of said planar glide base, said floor contact surface including a high-friction producing material.

23. A furniture glide for a foot of a piece of furniture comprising:

a planar glide base having a radially outer portion, a radially inner portion, and a foot support surface;

a plurality of spring fingers, each said spring finger formed integrally with and extending upwardly from said outer portion of said planar glide base and having an attached end connected to said outer portion of said planar glide base, each said spring finger having a distal end extending in an inward direction toward said inner portion of said planar glide base, each said distal end further extending in an outwardly arcuate direction away from said foot support surface;

a head positioned at about said distal end of each said spring finger, each said head being positioned to receive an outward expansion force from the foot to move at least one of said spring fingers in an outward direction away from said inner portion of said planar glide base when the foot is moved toward said foot support surface; and said spring fingers being positioned to move in an inward direction toward said inner portion of said planar glide base to engage and lock the foot to said furniture glide when the foot contacts said foot support surface.

24. The furniture glide of claim 23 wherein said foot support surface includes an indentation for receiving the foot.

25. The furniture glide of claim 23 wherein said foot support surface includes an indentation for receiving the foot, said foot support surface allowing the foot to exert shear forces against said planar glide base when the foot is moved across a floor.

26. The furniture glide of claim 23 wherein said spring fingers comprise four individual fingers which are connected at said attached ends to said outer portion of said planar glide base equidistantly in 90-degree increments around said outer portion.

27. The furniture glide of claim 23 further comprising a hole extending through said major planar dimension of said glide base, said hole having a hole diameter that is smaller than a foot diameter of the foot to prevent the foot from passing through said foot support surface.

28. The furniture glide of claim 23 wherein each of said spring fingers comprises a flexible material having a memory shape, said memory shape causing each of said spring fingers to move in an inward direction toward said inner portion of said planar glide base to engage and lock the foot to said furniture glide when the foot contacts said foot support surface.

29. The furniture glide of claim 23 wherein each of said spring fingers comprises a flexible, molded polymer material having a memory shape, said memory shape causing each of said spring fingers to move in an inward direction toward said inner portion of said planar glide base to engage and lock the foot to said furniture glide when the foot contacts said foot support surface.

30. The furniture glide of claim 23 wherein each of said spring fingers is spring biased toward said inner portion of said glide base, said spring bias causing each of said spring fingers to move in an inward direction toward said inner portion of said planar glide base to engage and lock the foot to said furniture glide when the foot contacts said foot support surface.

31. The furniture glide of claim 23 wherein said planar glide base and said spring fingers are molded into a single, flexible furniture glide assembly.

32. The furniture glide of claim 23 wherein each of said spring fingers are connected at said attached ends with hinges to said glide base and spring biased toward said inner portion of said glide base, causing said distal ends of each of said spring fingers to move in an inward direction toward said inner portion of said glide base to engage and lock said foot to said furniture glide when the foot contacts said foot support surface.

33. The furniture glide of claim 23 wherein each of said spring finger is connected at said attached end with a living hinge to said glide base.

34. The furniture glide of claim 23 wherein each of said spring fingers is slidably positioned on said glide base and biased to an inward direction toward said inner portion of said glide base, each said finger being positioned to slidably move against its bias in an outward direction away from said inner portion of said glide base when the foot exerts an outward expansion force against said fingers.

35. The furniture glide of claim 23 further comprising a floor contact surface of said planar glide base that minimizes noise when said furniture glide drags against a floor while engaging the foot.

36. The furniture glide of claim 23 further comprising a floor contact surface of said planar glide base that minimizes damage to floor surfaces when said furniture glide drags against a floor while engaging the foot.

37. The furniture glide of claim 23 further comprising a floor contact surface of said glide base, said floor contact surface being dimpled to reduce friction against a floor when said furniture glide drags against the floor while engaging the foot.

38. The furniture glide of claim 23 wherein said glide base includes a plurality of floor contact blisters that minimize friction when said furniture glide drags against a floor while engaging the foot.

39. The furniture glide of claim 23 wherein said glide base includes a plurality of donut dimples that minimize friction when said furniture glide drags against floor while engaging the foot.

40. The furniture glide of claim 23 further comprising a floor contact surface of said glide base, said floor contact surface including felt to reduce friction against a floor when said furniture glide drags against the floor while engaging the foot.

41. The furniture glide of claim 23 further comprising a floor contact surface of said planar glide base, said floor contact surface including a low friction producing material that minimizes noise when said furniture glide drags against a floor while engaging the foot.

42. The furniture glide of claim 23 further comprising a floor contact surface of said planar glide base, said floor contact surface including a low-friction producing material that minimizes damage to floor surfaces when said furniture glide drags against the floor while engaging the foot.

43. The furniture glide of claim 23 further comprising a floor contact surface of said glide base, said floor contact surface including a low-friction producing material that is attached to said glide base with a dovetail fitting.

44. The furniture glide of claim 23 further comprising a floor contact surface of said glide base, said floor contact surface including a low-friction producing material that is attached to said glide base with an undercut fitting.

45. The furniture glide of claim 23 further comprising a floor contact surface of said planar glide base, said floor contact surface including a low-friction producing material that is mechanically attached to said glide base.

46. The furniture glide of claim 23 further comprising a floor contact surface of said glide base, said floor contact surface including a low-friction producing material that is adhesively attached to said glide base.

47. The furniture glide of claim 23 further comprising a floor contact surface of said planar glide base, said floor contact surface including a high-friction producing material.

48. A furniture glide for a foot of a piece of furniture comprising:

a planar glide base having a radially inner portion, a radially outer portion and a foot support surface, said foot support surface having an indentation for receiving the foot;

a plurality of spring fingers, each said spring finger formed integrally with and extending upwardly from said outer portion of said planar glide base and having an attached end connected to said glide base, each said spring finger having a distal end extending in an inward direction toward said inner portion of said planar glide base, each said distal end further extending in an outward direction away from said foot support surface;

a head positioned at about said distal end of each said spring finger, each said head being positioned to receive an outward expansion force from the foot to move at least one of said spring fingers in an outward direction away from said inner portion of said planar glide base when the foot is moved toward said foot support surface;

said spring fingers being positioned to move in an inward direction toward said inner portion of said planar glide base to engage and lock the foot to said furniture glide when the foot contacts said foot support surface, said foot support surface allowing the foot to exert shear forces against said planar glide base when the foot is moved across a floor.

49. The furniture glide of claim 48 wherein said spring fingers are connected at said attached ends to said planar glide base equidistantly in 90-degree increments.

50. The furniture glide of claim 48 further comprising a hole extending through said major planar dimension of said glide base, said hole having a hole diameter that is smaller than a foot diameter of the foot to prevent the foot from passing through said foot support surface.

51. The furniture glide of claim 48 wherein each of said spring fingers comprises a flexible material having a memory shape, said memory shape causing each of said spring fingers to move in an inward direction toward said inner portion of said planar glide base to engage and lock the foot to said furniture glide when the foot contacts said foot support surface.

52. The furniture glide of claim 48 wherein each of said spring fingers comprises a flexible molded polymer material having a memory shape, said memory shape causing each of said spring fingers to move in an inward direction toward said inner portion of said planar glide base to engage and lock the foot to said furniture glide when the foot contacts said foot support surface.

53. The furniture glide of claim 48 wherein each of said spring fingers is spring biased toward said inner portion of said planar glide base, said spring bias causing each of said spring fingers to move in an inward direction toward said inner portion of said planar glide base to engage and lock the foot to said furniture glide when the foot contacts said foot support surface.

54. The furniture glide of claim 48 wherein said planar glide base and said spring fingers are molded into a single, flexible furniture glide assembly.

55. The furniture glide of claim 48 wherein each of said spring fingers are connected at said attached ends with hinges to said glide base and spring biased toward said inner portion of said glide base, causing said distal ends of each of said spring fingers to move in an inward direction toward said inner portion of said glide base to engage and lock the foot to said furniture glide when the foot contacts said foot support surface.

56. The furniture glide of claim 48 wherein each of said spring fingers is connected at said attached end with a living hinge to said glide base.

57. The furniture glide of claim 48 wherein each of said spring fingers is slidably positioned on said glide base and biased to an inward direction toward said inner portion of said glide base, each said finger being positioned to slidably move against its bias in an outward direction away from said inner portion of said glide base when the foot exerts an outward expansion force against said fingers.

58. The furniture glide of claim 48 further comprising a floor contact surface of said planar glide base that minimizes noise when said furniture glide drags against a floor while engaging the foot.

59. The furniture glide of claim 48 further comprising a floor contact surface of said planar glide base that minimizes damage to floor surfaces when said furniture glide drags against a floor while engaging the foot.

60. The furniture glide of claim 48 further comprising a floor contact surface of said glide base, said floor contact surface being dimpled to reduce friction against a floor when said furniture glide drags against the floor while engaging the foot.

61. The furniture glide of claim 48 wherein said glide base includes a plurality of floor contact blisters that minimize friction when said furniture glide drags against a floor while engaging the foot.

62. The furniture glide of claim 48 wherein said glide base includes a plurality of donut dimples that minimize friction when said furniture glide drags against a floor while engaging the foot.

63. The furniture glide of claim 48 further comprising a floor contact surface of said glide base, said floor contact surface including felt to reduce friction against a floor when said furniture glide drags against the floor while engaging the foot.

64. The furniture glide of claim 48 further comprising a floor contacting surface of said planar glide base, said floor contact surface including a low friction-producing material that minimizes noise when said furniture glide drags against a floor while engaging the foot.

65. The furniture glide of claim 48 further comprising a floor contact surface of said planar glide base, said floor contact surface including a low-friction producing material that minimizes damage to floor surfaces when said furniture glide drags against a floor while engaging the foot.

66. The furniture glide of claim 48 further comprising a floor contact surface of said glide base, said floor contact surface including a low-friction producing material that is attached to said glide base with a dovetail fitting.

67. The furniture glide of claim 48 further comprising a floor contact surface of said glide base, said floor contact surface including a low-friction producing material that is attached to said glide base with an undercut fitting.

68. The furniture glide of claim 48 further comprising a floor contact surface of said planar glide base, said floor contact surface including a low-friction producing material that is mechanically attached to said glide base.

69. The furniture glide of claim 48 further comprising a floor contact surface of said glide base, said floor contact surface including a low-friction producing material that is adhesively attached to said glide base.

70. The furniture glide of claim 48 further comprising a floor contact surface of said planar glide base, said floor contact surface including a high-friction producing material.

71. A furniture glide cap for a foot of a piece of furniture comprising:

a planar glide base having a radially outer portion, a radially inner portion, and a foot support surface;

four individual spring fingers, each said spring finger formed integrally with and extending upwardly from said outer portion of said planar glide base and having an attached end connected to said outer portion of said glide planar base, each said spring finger having a distal end extending in an inward direction toward said inner portion of said planar glide base, each said distal end further extending in an outward arcuate direction away from said foot support surface, each of said spring fingers comprises a flexible molded material having a memory shape, said spring fingers being positioned equidistantly in 90-degree increments around said outer portion;

an indentation positioned on said foot support surface for receiving said foot;

a head positioned at about said distal end of each said spring finger, each said head being positioned to receive an outward expansion force from a foot to move at least one of said spring fingers in an outward direction away from said inner portion of said planar glide base when the foot is moved toward said foot support surface;

said memory shape causing each of said spring fingers to move in an inward direction toward said inner portion of said glide base to engage and lock the a plurality of spring fingers, each said spring finger being flexibly positioned on said glide base and having an attached end connected to said outer portion support surface, each of said spring fingers comprises a flexible molded material having a memory shape, said spring fingers being positioned about head being positioned to receive an outward expansion force from the foot to move at least one of said spring fingers in an outward direction away from foot to said furniture glide when the foot contacts said foot support surface, said foot support surface allowing the foot to exert shear forces against said glide base when the foot is moved across a floor; and a floor contact surface of said glide base including a low-friction producing material that minimizes noise and damage when said furniture glide drags against the floor while engaging the foot.

72. A furniture glide cap for a foot of a piece of furniture comprising:

a planar glide base having a radially outer portion, a radially inner portion, and a foot support surface;

a plurality of spring fingers, each said spring finger formed integrally with and extending upwardly from said outer portion of said planar glide base and having an attached end connected to said outer portion of said planar glide base, each said spring finger having a distal end extending in an inward direction toward said inner portion of said planar glide base, each said distal end further extending in an outward arcuate direction away from said foot support surface, each of said spring fingers comprises a flexible molded material having a memory shape, said spring fingers being positioned about equidistantly in 90-degree increments around said outer portion;

an indentation positioned on said foot support surface for receiving said foot;

a head positioned at about said distal end of each said spring finger, each said head being positioned to receive an outward expansion force from the foot to move at least one of said spring fingers in an outward direction away from said inner portion of said planar glide base when the foot is moved toward said foot support surface;

said memory shape causing each of said spring fingers to move in an inward direction toward said inner portion of said planar glide base to engage and lock the foot to the furniture glide when the foot contacts said foot support surface, said foot support surface allowing the foot to exert shear forces against said planar glide base when the foot is moved across a floor; and a floor contact surface of said planar glide base including a low-friction producing material that minimizes noise and damage when said furniture glide drags against the floor while engaging the foot.

* * * * *